US008783137B2

(12) United States Patent
Hamilton

(10) Patent No.: US 8,783,137 B2
(45) Date of Patent: Jul. 22, 2014

(54) APPARATUS FOR SPINNING DRILL PIPE

(75) Inventor: William R. Hamilton, Conroe, TX (US)

(73) Assignee: Blohm + Voss Oil Tools, LLC, Houston, TX (US)

( * ) Notice: Subject to any disclaimer, the term of this patent is extended or adjusted under 35 U.S.C. 154(b) by 1754 days.

(21) Appl. No.: 11/404,317

(22) Filed: Apr. 14, 2006

(65) Prior Publication Data

US 2007/0240542 A1 Oct. 18, 2007

(51) Int. Cl.
*B25B 13/50* (2006.01)
*E21B 19/16* (2006.01)

(52) U.S. Cl.
CPC ..... *E21B 19/168* (2013.01)
USPC ..... 81/57.15; 81/57.33

(58) Field of Classification Search
USPC ..... 81/57.15, 57.17, 57.19, 57.16, 57.2, 81/57.33, 57.5
See application file for complete search history.

(56) References Cited

U.S. PATENT DOCUMENTS 3,892,140 A * 7/1975 Fox et al. ..... 474/121
4,023,449 A * 5/1977 Boyadjieff ..... 81/57.16
4,212,212 A * 7/1980 Chandler et al. ..... 81/57.17
4,649,777 A * 3/1987 Buck ..... 81/57.19
4,714,289 A * 12/1987 Arzenti et al. ..... 294/119.3
4,774,861 A * 10/1988 Hamilton et al. ..... 81/57.33
4,843,924 A * 7/1989 Hauk ..... 81/57.2
4,989,909 A * 2/1991 Bouligny et al. ..... 294/119.3
5,660,087 A * 8/1997 Rae ..... 81/57.2
5,950,058 A * 9/1999 Kusaba et al. ..... 399/302
6,065,372 A * 5/2000 Rauch ..... 81/57.15
6,253,845 B1 * 7/2001 Belik ..... 166/77.51
6,412,554 B1 * 7/2002 Allen et al. ..... 166/80.1
6,488,323 B1 * 12/2002 Bouligny ..... 294/119.3
6,668,684 B2 * 12/2003 Allen et al. ..... 81/57.15
6,755,097 B2 * 6/2004 Bangert ..... 81/57.5
7,036,396 B2 * 5/2006 Moe et al. ..... 81/57.2
7,036,397 B2 * 5/2006 Bangert ..... 81/57.5
7,117,938 B2 * 10/2006 Hamilton et al. ..... 166/77.53
2002/0121160 A1 * 9/2002 Bangert ..... 81/57.5
2004/0055421 A1 * 3/2004 Bangert ..... 81/57.15
2005/0056122 A1 * 3/2005 Belik ..... 81/57.16

* cited by examiner

*Primary Examiner* — David B Thomas
(74) *Attorney, Agent, or Firm* — Osha Liang LLP

(57) ABSTRACT

Spinners for spinning drill pipe to rotary drill wells wherein the spinners have one or more drive rollers wherein one embodiment the drive rollers have an upper section that is a metal core with an upper flanged area and a lower section comprised of an elastomeric material. In a second embodiment the surface areas of the drive rollers that contact the drill pipe are all metallic and the drive rollers have an upper cylindrical section and one or more conical sections below the upper cylindrical section that are progressively smaller in diameter moving downward from the upper cylindrical section. In a third embodiment the surface areas of the drive rollers that contact the drill pipe are all metallic and are comprised of a cylindrical section and a predominately spherical section below the cylindrical section. In a fourth embodiment the surface area of the drive rollers that contacts the drill pipe is all metallic and has a predominately spherical section.

12 Claims, 7 Drawing Sheets

APPARATUS FOR SPINNING DRILL PIPE

FIELD OF THE INVENTION

This invention relates generally to apparatus for rotary drilling of oil and gas wells. In particular it relates to apparatus for spinning drill pipe sections.

BACKGROUND OF THE INVENTION

Oil and gas wells are rotary drilled using a drill string and are made up of drill pipe joints. A drill pipe joint is a length of pipe typically about 30 feet long with rotary shouldered tool joints welded to each end, one end being a female threaded tool joint and the other end a male threaded tool joint. A stand of drill pipe typically is three joints of drill pipe. A stand of drill pipe typically has one to five stands of drill collars. A drill collar is a section of heavy wall tube with a rotary shouldered connection located at the bottom of the string adjacent to the drill bit. Drill string connections are commonly called rotary shouldered connections.

Periodically, part or all of the drill string is removed from the hole to change the bit or to add casing as drilling progresses and the bore hole becomes deeper. Casing is permanent lining in the well.

To add or remove drill pipe or drill collar segments to or from the drill string, the existing connections between the segments must be broken loose and rotated counter clockwise multiple times to disengage the threaded connection and separate the segments so that the segment can be removed from the drill string. The pipe sections must be rotated clockwise and retightened to form a tight seal to continue drilling.

The rotating or "spinning" portion of the operation can be done by hand using a chain wrench or with a spinning chain wherein a chain is wrapped around the pipe and pulled by a winch. The hand methods are time consuming and the spinning chain method is dangerous to rig personnel. Accordingly, powered spinning machines are commonly employed; they decrease spinning time and accidents.

Current commercial spinners are pneumatically or hydraulically powered machines which grip the drill pipe with cylindrical rollers, or loops of special chain called silent chain, or special belts. These spinners must grip the drill pipe surface where it is cylindrical and uniform and smooth to preclude damaging the spinner components and to ensure adequate contact between the spinner and the drill pipe to transmit torque.

The transition area, where the tool joint is welded to the drill pipe, is typically rough and irregular from the pipe manufacturing process and is unsuitable to be gripped by conventional spinners. Typically, drill pipe transition zones have their smallest diameter below the drill pipe and the transition zone diameter progressively increases before flaring out quickly on the tool joint to become the tong space. The length of the transition section is typically only a few inches but with conventional spinners the spinner has to be applied well away from the tool joint to ensure that no part of the spinner touches the transition zone. Gripping the transition area using chain type spinners will cause premature failure of the drive chain, typically within hours; the drive chain is an expensive unit. Manufacturers of current spinners specifically instruct operators to keep their spinners away from the transition zone. Accordingly, to keep the spinner away from the tool joint, the spinner must be located a foot or so above the wrench.

Toothed rollers clamped to the tong area of the tool joint have been used. Current operators eschew toothed rollers because they damage the tool joint and sealing surface by trapping shavings between the machined faces of the rotary shouldered connection, damaging the sealing surface.

A drill pipe spinner that can grip the drill pipe on the transition zone would be more compact and cost less than current spinners. It would increase visibility for the roughneck crew and decrease effort to move it thereby reducing crew fatigue. Its compactness would permit the spinner to be used on small drilling rigs which can not accommodate current commercial machines. Transportation of the rig would be easier and safer and present less chance of damaging the machine and be more accessible to remote drilling sites that are difficult to reach with trucks. It would reduce topside weight of offshore rigs. Such a spinner used alone with manual tongs would also be less restrictive and allow the spinner to be placed lower when desired.

A spinner with capability to grip the drill pipe transition zone is particularly advantageous for Iron Roughneck machines in reducing size and operability. An Iron Roughneck machine is a combined spinner and hydraulic wrench that both hydraulically power spins and torques the tool joints.

Machining the transition zone of drill pipe to make the transition zone smooth and cylindrical in the pipe mill or in the field by hand grinding is commercially impractical. Drill pipe is a standard interchangeable commodity. If a spinner maker were to specify that his machine can only be used with custom non-standard drill pipe with smooth transition zones it is unlikely that drilling contractors would buy it because the pipe would cost more than standard pipe, require field service, and not be interchangeable between rigs.

SUMMARY OF THE INVENTION

The present invention are spinners for spinning drill pipe to rotary drill wells wherein the drive rollers in the spinners can tightly grip the drill pipe in the transition zone, immediately above the tool joint, where the drill pipe surface is rough and irregular, without doing damage to the spinner or drill pipe, and retaining capability to grip the fully cylindrical areas of drill pipe.

If drill pipe were to be gripped on the transition zone with conventional drive rollers of current design, because the transition zone is rough and uneven, roller contact would generally be made in the lower corner of the roller, increasing wear in this portion of the roller face. Additionally, torque loading would be imposed on the spinner arms and other components that would damage the pipe and spinner.

The preferred embodiment of spinners of the present invention have drive rollers with a steel core with an upper flanged area and a lower section of slightly larger diameter that includes an elastomeric composite material. As the drive rollers are moved against the drill pipe, the elastomeric composite section contacts the pipe first and compresses until the steel section contacts the pipe. As the elastomer is compressed around the pipe transition zone it adapts to fit the irregularities of the transition zone to make good contact and provide a tight grip for the roller on the pipe. The preferred elastomeric composite for this preferred form of spinner includes a polyurethane composite. The preferred polyurethane composite is a proprietary material sold commercially under the common law trademark GRIPTHANE by the Gray EOT, Inc. in Willis, Tex.

A suitable rubber could be used in this application in addition to or in place of the polyurethane.

Suitable solid abrasives such as sand (silica) or metal powder can be added to the composition to enhance the increase the frictional gripping property of the elastomer composite.

Fibers including glass fiber, carbon fiber, Kevlar and nylon can also be added to the elastomer composite to increase its toughness.

Another embodiment of the present invention is a spinner that has drive rollers with all metallic gripping sections. One embodiment of an all metallic spinner of this invention has an upper cylindrical section and one or more conical sections below the upper cylindrical section that are progressively smaller in diameter moving downward from the upper cylindrical section.

Still another embodiment of spinners of the present invention with drive rollers that have all metallic gripping sections have a cylindrical section and a predominately spherical section below the cylindrical section.

Another embodiment of the spinners of the present invention with drive rollers with all metallic gripping sections have gripping sections that are predominately spherical.

The preferred material for the all metallic gripping sections is steel. The preferred steel is AISI 4140 steel which is heat treated to a hardness of 30Rc. Steels that have not been heat treated, aluminum, bronze, and other copper based alloys are also suitable as the metals in the all metallic gripping sections of drive rollers of the spinners of this invention.

The present invention also includes Iron Roughneck machines wherein the spinners in the Iron Roughneck are spinners of the present invention described herein.

DETAILED DESCRIPTION OF THE INVENTION

The spinners of the present invention are used to add or remove sections of the drill string. This is done either at the well center or in a "mouse hole" (which is a hole in the drill floor near the well bore where joints of drill pipe are placed before they are added to the drill string). Crews operate spinners of the present invention in the same way as current spinners.

The spinners of the present invention have two substantially similar opposing drive frames that clamp around the drill pipe or drill collar. The drives engage the drill pipe wholly or partially in the transition zone area immediately above the tong space of the pin (male thread) end of the tool joint, or on the pipe body itself. The tool joint alone might be gripped also in special situations.

FIGS. 1 through 7 show how the spinners of the present invention are assembled. The assemblies are applicable to all spinners of the present invention.

Figure 1:
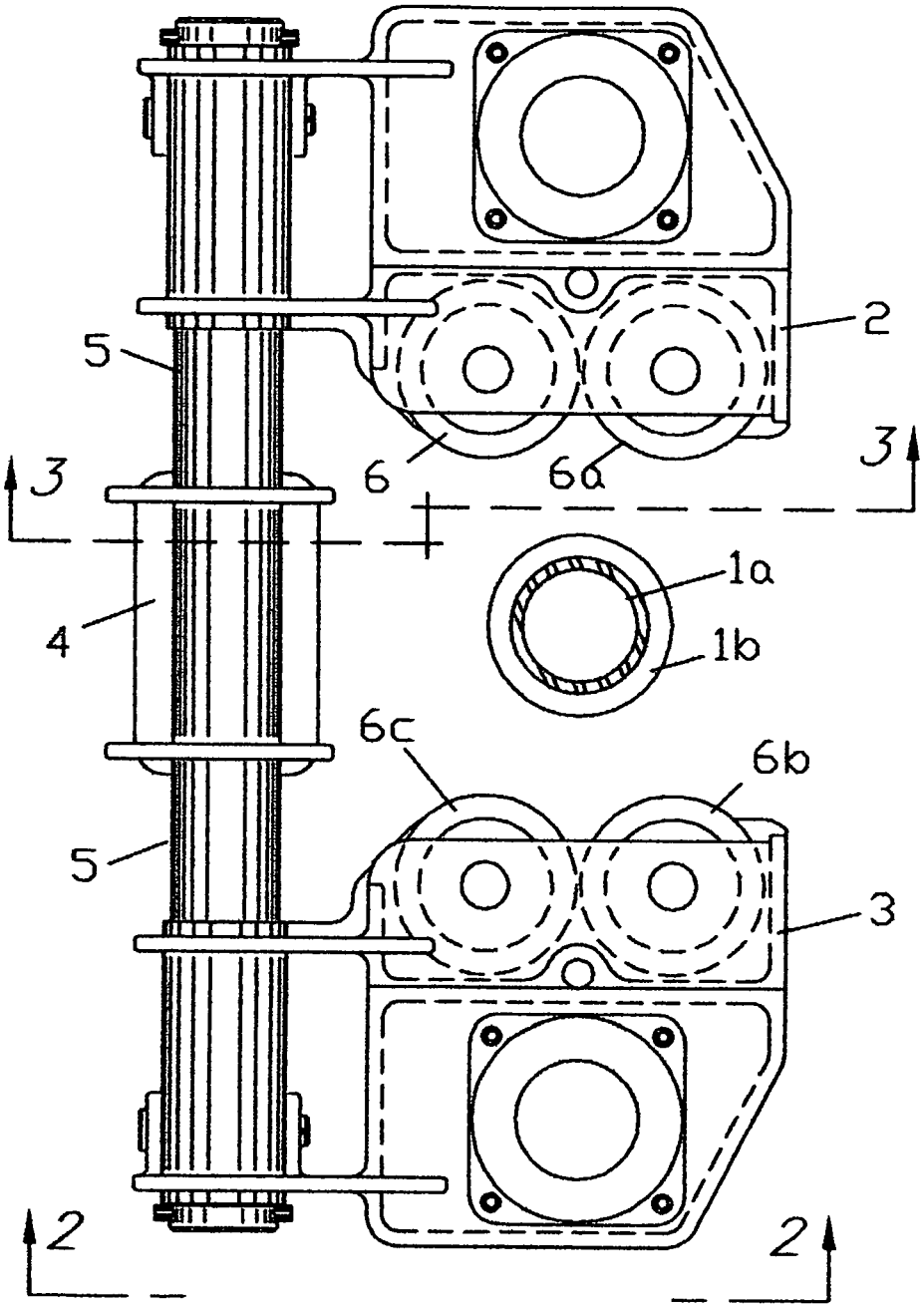
FIG. 1 is a top view of a spinner of the present invention.

FIG. 1 is a top view of a spinner of the present invention. The spinner frames 2 and 3 are supported by a central supporting structure 4. The spinner frames 2 and 3 slide towards and away from the drill pipe 1*a* on support pipes 5 and 5*a*, allowing the drive rollers 6 and 6*a* within frame 2 and drive rollers 6*b* and 6*c* within frame 3 to be brought into and out of engagement with drill pipe 1*a*, and/or tool joint 1*b* (the drill string). When not spinning drill pipe the spinner frames 2 and 3 are apart and the rollers 6, 6*a*, 6*b*, and 6*c* are out of engagement with the drill string.

Figure 2:
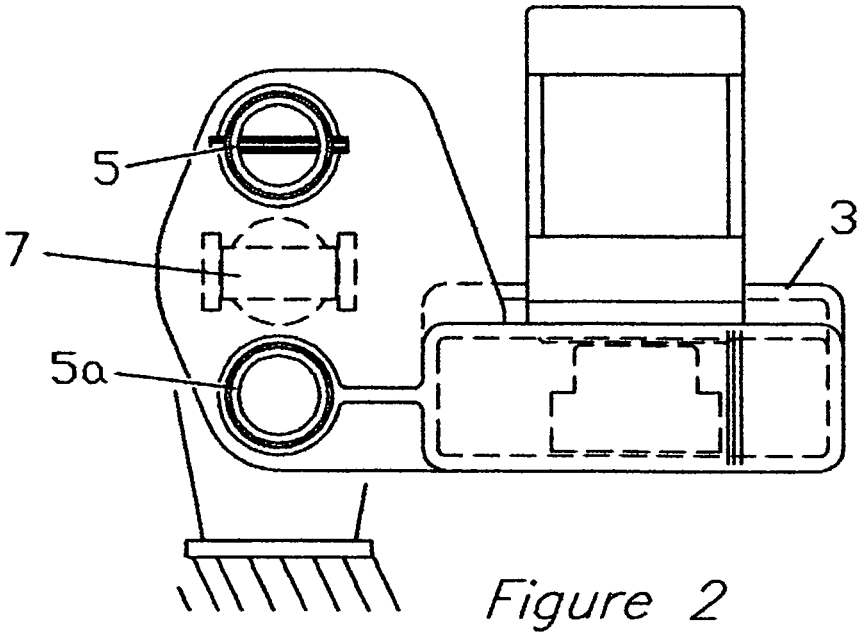
FIG. 2 is an end view of FIG. 1.

FIG. 2 is an end view of FIG. 1 showing the support pipes 5 and 5*a* and the outside of spinner frame 3. There are two support pipes 5 and 5*a* in parallel one mounted directly above the other. Fluid power cylinder is shown between the support pipes 5 and 5*a*.

Figure 3:
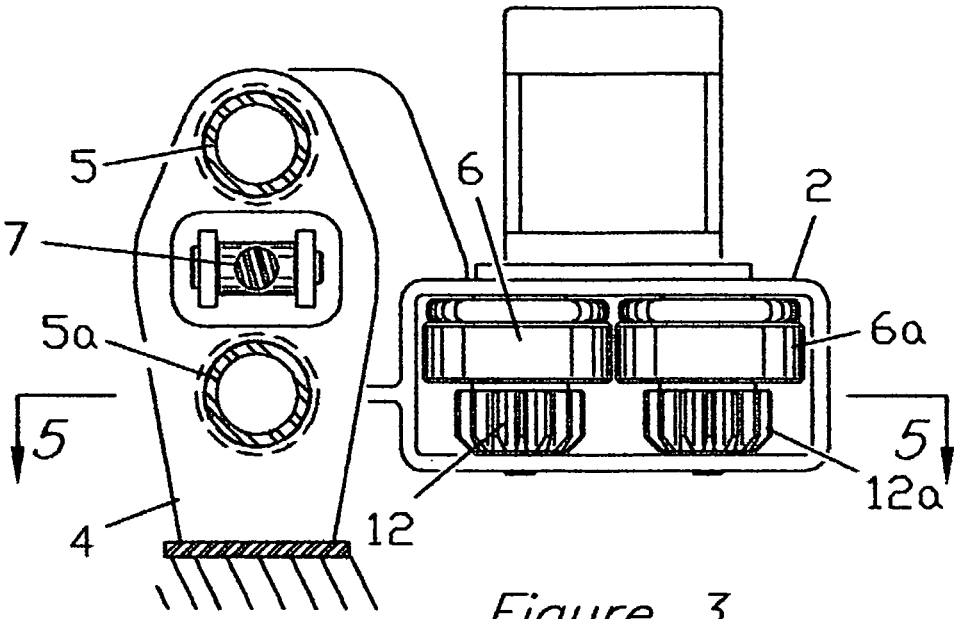
FIG. 3 is a sectional view of FIG. 1.

FIG. 3 is a sectional view of FIG. 1 defined by the section lines marked 3-3 on FIG. 1. The section shows the support frame 4 and associated support pipes 5 and 5*a* and the fluid power cylinder 7 placed between the support pipes 5 and 5*a* and behind the spinner frame 2. The arrangement of drive rollers 6 and 6*a* and drive gears 12 and 12*a* are shown within spinner frame 2.

Figure 4:
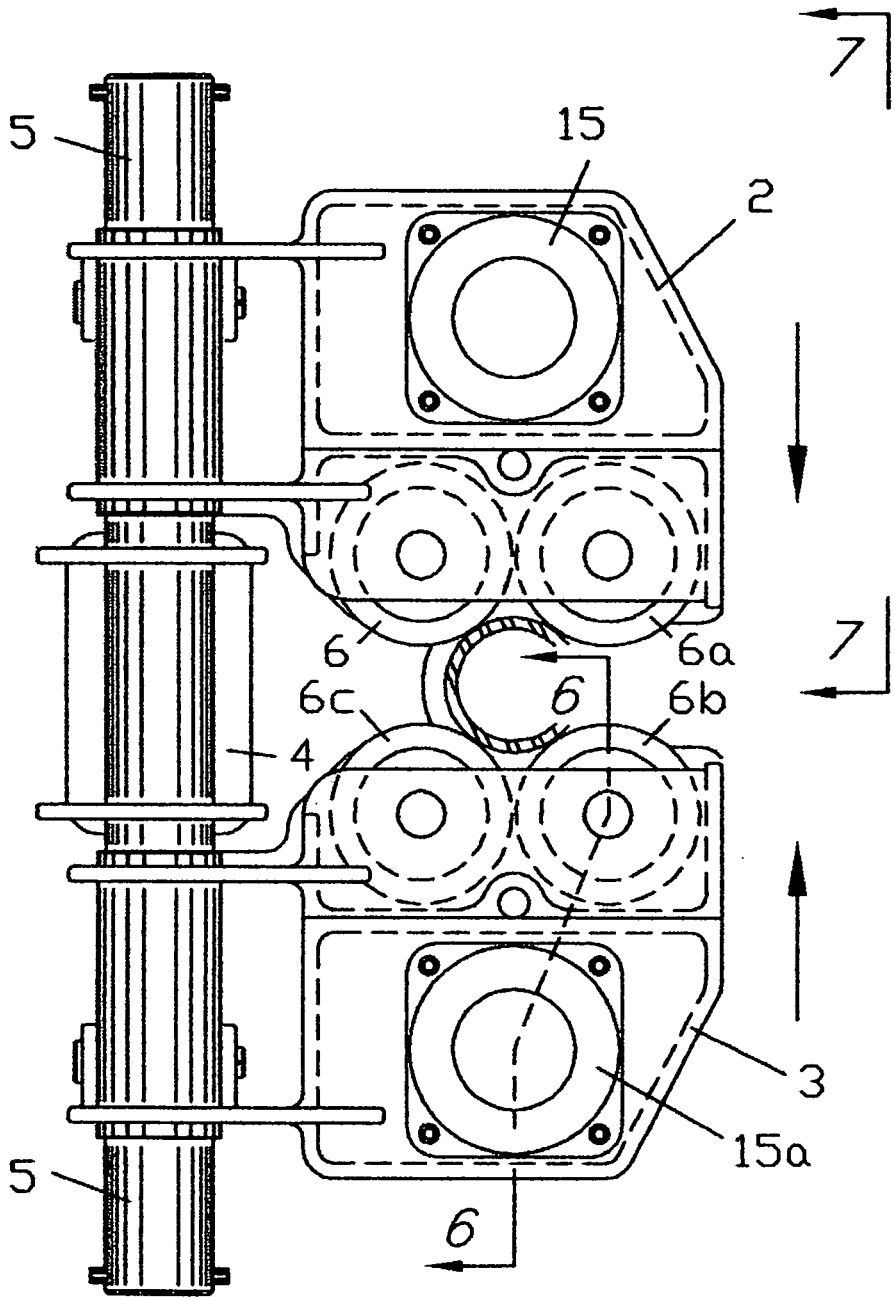
FIG. 4 is a top view of a spinner of the present invention.

FIG. 4 is the same as FIG. 1 except that the drive rollers 6, 6*a*, 6*b*, 6*c* are engaged with the drill pipe 1*a* on FIG. 4. Indicated on FIG. 4 is the support pipe 5. (Support pipe 5*a* and fluid power cylinder 7 are directly below support pipe 5 and are not seen). The section marked 6-6 shown on FIG. 4 defines FIG. 6. The section line begins near the tool joint 1*b*, goes through the center of the driver roller 6*b*, bearing 13*b*, and shaft 14*b* an then through the pinion gear 12*b* and drive motor shaft 16*b*.

Figure 5:
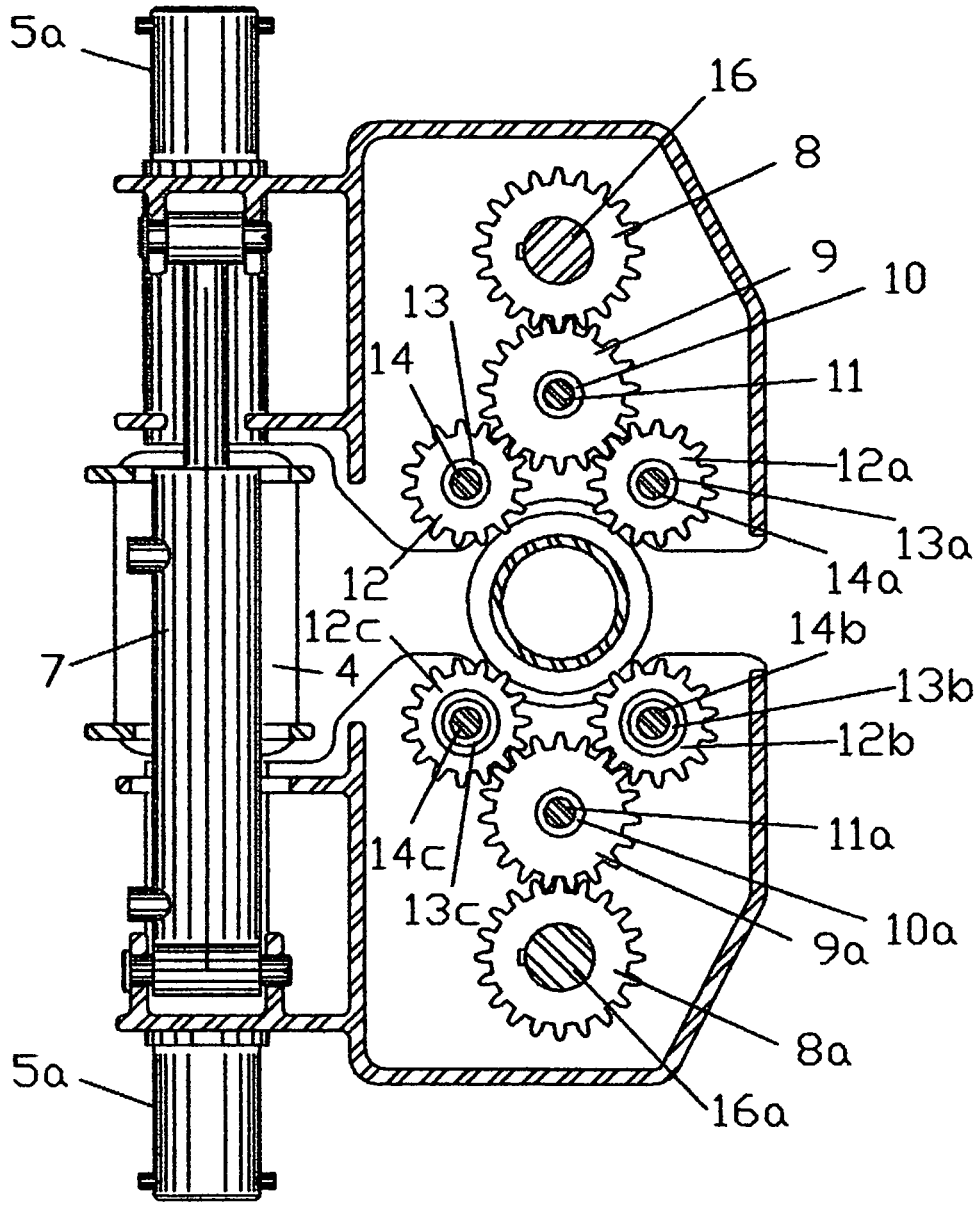
FIG. 5 is a sectional view cut from FIG. 4.

FIG. 5 is a sectional view cut from FIG. 4 marked 5-5 in FIG. 3. This view shows the location of the fluid power cylinder 7 as well as the gear drive arrangement. The shaft of the drive motor 16 is attached to the pinion gear 8. The pinion gear 8 rotates the idler gear 9 about the idler gear shaft 11. Idler gear 9 is supported by a bearing 10. Idler gear 9 rotates the driven gears 12 and 12*a* about the drive roller shafts 14 and 14*a* The driven gears 12 and 12*a* are supported by bearings 13 and 13*a*, respectively. The fluid power cylinder 7 causes the spinner frames 2 and 3 to slide along supporting pipes 5 and 5*a* to bring the drive rollers 6, 6*a*, 6*b*, and 6*c* contained within spinner frames 2 and 3 into and out of engagement with the drill string 1.

An identical driver train is contained in both drive frames 2 and 3. It is possible to drive with as few as one powered drive roller, the remainder being used as idler rollers that keep pressure on the powered roller.

Figures 6, 7:
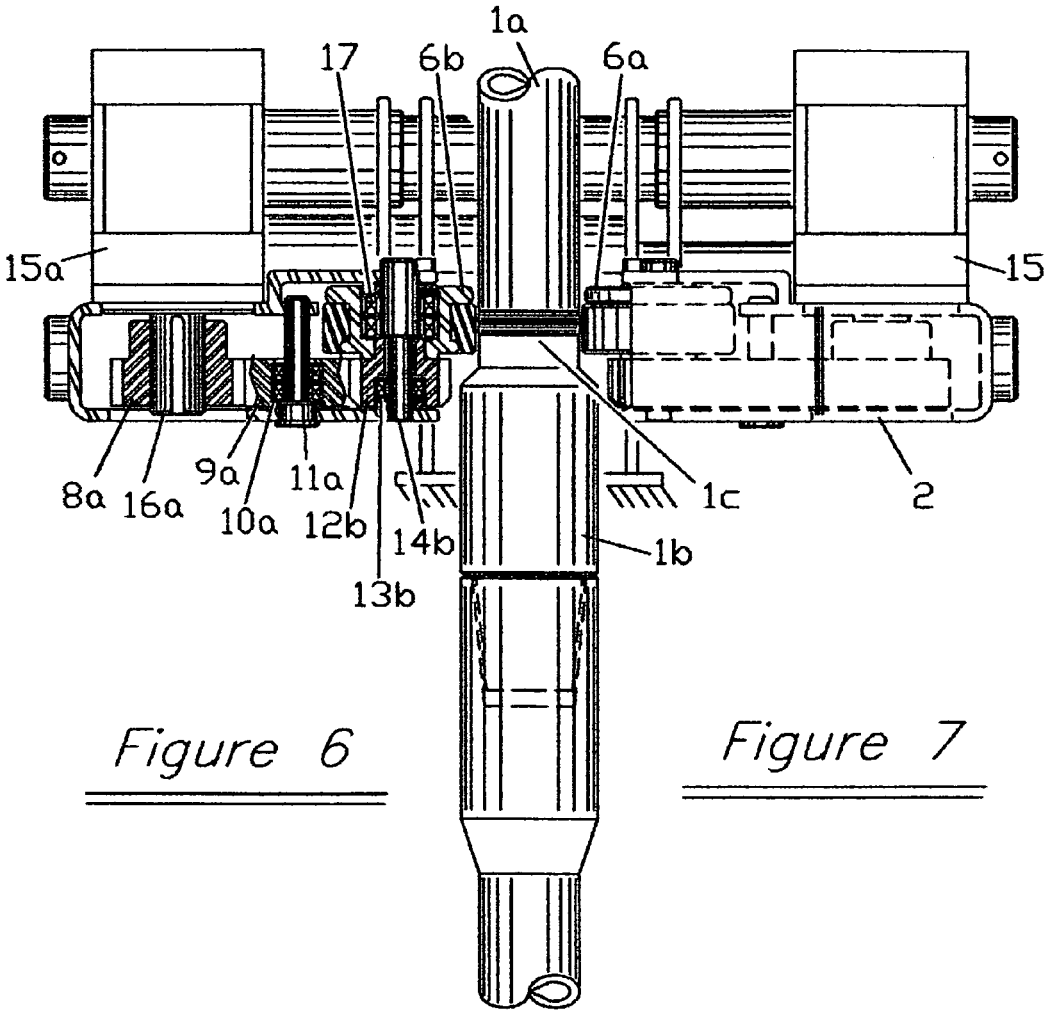
FIG. 6 is a sectional view shown as cut 6-6 in FIG. 4.
FIG. 7 is a view defined in FIG. 4.

FIG. 6 is a sectional view shown as cut 6-6 in FIG. 4. The view shows the arrangement of the drive motor 15*a* and drive shaft 16*a* Pinion gear 8*a* is attached to drive motor shaft 16*a* and turns idler gear 9*a* about the idler gear shaft 11*a*. Idler gear 9*a* is supported by bearing 10*a*. Idler gear 9*a* rotates the driven gear 12*b* (and driven gear 12*c* directly behind it not seen). Driven gear 12*b* is supported by bearing 13*b* and is rotated about driver roller shaft 14*b*. Drive roller 6*b* is coaxially located above and attached to drive gear 12*b*. Drive roller 6*b* is supported by bearing 17*b* which rotates about drive roller shaft 14*b*.

FIG. 7 is a view of the outside of frame 2 as defined in FIG. 4.

FIGS. 8, 9, 10, and 11 depict the drive rollers of the present invention. All of the drive rollers are incorporated within the drive frames 2 and 3 and are similarly attached coaxially to the driven gears 12, 12*a*, 12*b*, and 12*c* and engage the drill string in the same fashion. Drive rollers are interchangeable. In all cases, the normal force is transmitted in a similar fashion by the bearings 17, 17*a*, 17*b*, and 17*c* between their respective driver rollers 6, 6*a*, 6*b*, and 6*c* and their respective driver roller shafts 14, 14*a*, 14*b* and 14*c*.

Figure 8:
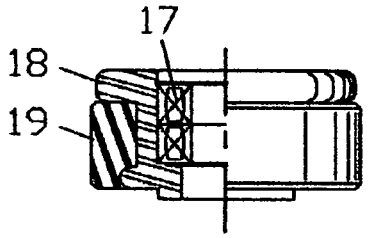
FIG. 8 is a side view and partial section of a drive roller for spinners of this invention.

FIG. 8 is a side view and partial section of a preferred drive roller, the roller that has a metallic core 18 having a radially extending upper flange or lip extending from the metallic core, and an elastomeric lower element 19 having an interior surface bonded to the core 18. The elastomeric lower element 19 includes a proximate end abutting the lower surface of the upper flange of the metallic core 18, and an opposite distal end which is in unobstructed communication with free space. With this configuration, when gripping the pipe, an exterior surface of the elastomeric lower element 19 will conform elastically to the pipe until the upper flange of the metallic core 18 comes into contact with the pipe limiting further compression of the elastomer element 19. Torque is transferred by both the metallic and elastomeric gripping elements 18 and 19, respectively. The preferred elastomeric component for this form of spinner of the present invention is a proprietary material sold commercially under the common law trademark GRIPTHANE by the Gray EOT, Inc. in Willis, Tex. GRIPTHANE includes a form of the elastomer polyurethane.

A suitable rubber could be used in this application in addition to or in place of polyurethane composite. Suitable solid abrasives such as sand (silica) or metal powder can be added to the composition to enhance the increase the frictional gripping property of the elastomeric composite without detracting from its elastic properties.

Fibers including glass strand, carbon, Kevlar, and nylon can also be added to the elastomeric composite to increase its toughness and tearing resistance.

Other drive rollers for spinners of the present invention have all metallic gripping sections. Preferably they are made so that the upper metal sections have the largest diameter and the one or more lower sections have progressively smaller diameters.

Figure 9:
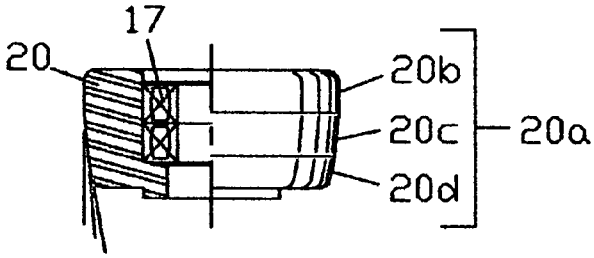
FIG. 9 is a side view and partial section of a drive roller for spinners of this invention.

FIG. 9 is a side view and partial section of the driver roller of a spinner of the present invention that has all metallic gripping elements 20. The outer profile 20*a* of the gripping element 20 has an upper section that is cylindrical 20*b* well suited to grip the drill pipe body 1*a* above the transition zone 1*c* and predominately conical sections 20*c* and 20*d* below the upper cylinder section 20*b*. The conical sections are progressively smaller in diameter moving downward to conform to the irregularities of the transition zone 1*c*.

Figure 10:
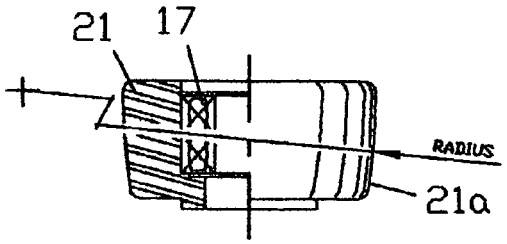
FIG. 10 is a side view and partial section a drive roller for spinners of this invention.

FIG. 10 is a side view and partial section of another drive roller of a spinner of the present invention that has all metal gripping elements 21. The outer profile 21*a* of the gripping element 21 is predominately spherically shaped to conform to the irregularities of the transition zone 1*c* between the drill pipe 1*a* and tool joints 1*b*.

Figure 11:
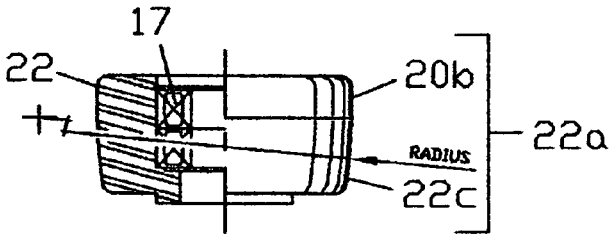
FIG. 11 is a side view and partial section of a drive roller for spinners of this invention.

FIG. 11 is a side view and partial section of a third drive roller that has all metal gripping elements 22. The outer profile 22*a* of the gripping element 22 has an upper cylindrical section 22*b*, well suited to grip the drill pipe body 1*a* above the transition zone 1*c*, and a predominately spherical section 22*c* below the spherical section that conforms to the irregularities of the transition zone 1*c*.

Figure 12:
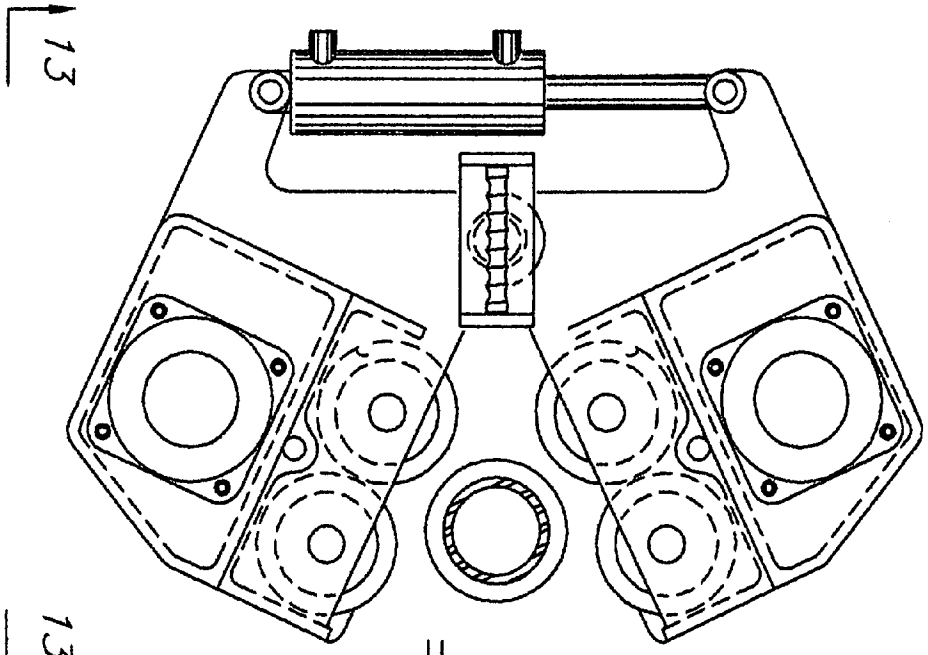
FIG. 12 is a top view of a spinner.

FIG. 12 is a top view of the spinner of a spinner of the present invention arranged with a pivoting configuration.

Figure 13:
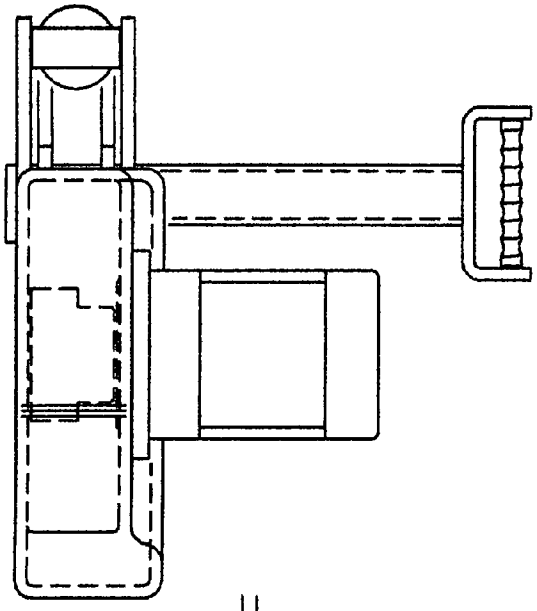
FIG. 13 is a side view of the spinner in FIG. 12.

FIG. 13 is a side view of the outside of the frame as shown in FIG. 12.

The preferred material for the gripping surfaces of all metallic drive rollers of this invention is AISI 4140 steel that is heat treated to a hardness of 30Rc. This steel is a good compromise between durability and gripping capability. Rollers with softer steels wear faster but harder steels do not grip as well. Accordingly, harder steels require longer contact zones which increase the size of the spinner. Other steel, heat treated or not, aluminum, bronze, and other copper based alloys are also suitable for the all metallic drive rollers.

The preferred inventive spinners have two similar but opposing drive frames that move on a central supporting structure. In the figures herein, for illustrative purposes, the inventive spinner has drive frames supported on horizontal tubular pipe supports so the frames slide inwardly to engage the drill pipe and outwardly to release it. Alternatively, the two frames can be hinged about a vertical shaft or shafts and pivotally brought into engagement with the pipe as illustrated in FIGS. 12 and 13.

Each spinner frame has a motor attached. The drive motors can be hydraulic or pneumatic. Electric motors are not generally suitable for this application because they are more trouble prone, less safe, and not cost competitive. Hydraulic motors are preferred over pneumatic motors in Iron Roughneck machines because hydraulic motors are more compact and less noisy. Pneumatic motors are preferred for rigs with no other hydraulic duties.

Each motor has a pinion gear attached. Each spinner frame has an idler gear that is driven by the pinion gear. Each idler gear drives one or more driven gears that are mounted on shafts near the central opening of the spinner. A drive roller is mounted on each drive roller and rotates coaxially with each driven gear. The gear/drive roller rotates about a shaft and is supported by one or more bearings. Alternatively, some of the gear/drive rollers can be replaced with non-driven rollers that serve as idler rollers that provide pressure for the drive rollers. Alternatively, the idler gears can be eliminated and the driven gears directly driven by the pinion gear.

The spinner frame is moved inwardly and outwardly toward the tool joint by one or more fluid power cylinders. These cylinders may be either hydraulic or pneumatic. Alternatively, other means of linear actuation may be used such a lead screws or linkages to provide the motion required to move the spinner roller into engagement with the tool joint. The cylinders may be attached directly between the spinner frames or may be attached indirectly through a central attachment point.

The drive rollers can be driven by external means such as individually driven hydraulic motors or a combination of driven and non-driven rollers. Additionally, the power can be transmitted by roller chain chains or other transmissions.

In addition to use with a hanging frame the spinners of the present invention can be incorporated into Iron Roughneck machines such as the Iron Roughneck machine specified in Patent Application No. 20030221871 entitled ARRANGEMENT FOR SPINNING AND TORQUING TOOL JOINTS, which is hereby incorporated herein by reference. Existing conventional drive rollers in current Iron Roughnecks can be replaced with drive rollers of this invention as described above to convert the Iron Roughneck to an embodiment of the present invention. Accordingly, Iron Roughneck machines that have spinners of the present invention are embodiments of this invention.

The two functions of an Iron Roughneck machine are tonging (wrenching) and spinning. Iron Roughnecks include a mechanical wrench or manual tongs to apply high torque to break and tighten the tool joint. Tonging is the use of large wrenches that are in the iron roughneck to apply high torque and limited rotation to do the final makeup tightening or initial joint breakout of the rotary shouldered connections. Tonging can also be done with manual tongs. Spinning is rotating the drill pipe through multiple turns to separate and close the tool joint. Spinning draws moderate torque. During tonging, the spinner clamp cylinder is extended, moving the spinner away from the tool joint.

To spin pipe the spinner clamp cylinder is actuated to pull the spinner halves inwardly until the rollers contact the pipe. The pressure in the clamp cylinder then builds to provide the normal force required to transmit the torque required for spinning the tool joint After the clamping cylinder has reached the required pressure, the hydraulic motors are actuated to provide torque to the gear drive to turn the drive rollers. When the spinning operation has been completed, the clamping cylinder is again extended to move the spinner frames apart thereby disengaging the rollers from and moving the rollers away from the drill pipe. The spinner frames move inwardly (toward the drill pipe and tool joint) and outwardly (away from the drill pipe and tool joint) with respect to the support frame.

The invention is not limited to the specific embodiments described above but rather is applicable broadly to all variations within the scope of the claims.

I claim:

1. A device for spinning drill pipe having a uniform cylindrical pipe section, a tool joint attached to each end of the pipe section, and a transition zone located between each end of the pipe section and the corresponding tool joint, the transition zone having a rough outer surface and being of varying diameter, said device comprising:

a spinner frame moveable between a first position and a second position; and a drive roller rotatably attached to said spinner frame, said drive roller being spaced apart from the drill pipe when said spinner frame is in said first position and said drive roller being in contact with the drill pipe when said spinner frame is in said second position;

said drive roller having an upper section positioned on said driver roller so as to contact a portion of the pipe section above the transition zone when said spinner frame is in said second position to spin the drill pipe;

said drive roller having a lower section composed of a compressible elastomeric material;

said lower section positioned on said drive roller so as to contact the transition zone when said spinner frame is in said second position to spin the drill pipe;

wherein said upper section has a predetermined diameter and said lower section has a first diameter when said spinner frame is in said first position and a second diameter when said spinner frame is in said second position, and wherein said first diameter extends beyond said predetermined diameter and said second diameter is generally the same as said predetermined diameter.

2. The device of claim 1, wherein, said upper section is formed of a metallic material.

3. The device of claim 2, wherein said metallic material is steel.

4. The device of claim 3, wherein said steel is AISI 4140 steel heat treated to 30Rc hardness.

5. The device of claim 2, wherein said metallic material is selected from steel that is not heat treated, aluminum, bronze, and copper based alloys.

6. The device of claim 1, wherein said elastomeric material is a rubber.

7. The device of claim 1, wherein said elastomeric material contains a solid abrasive.

8. The device of claim 7, wherein said solid abrasive is one or more selected from among sand and metal powder.

9. The device of claim 1, wherein said elastomeric material contains a fiber material.

10. The device of claim 9, wherein said fiber material is selected from glass fiber, carbon fiber, Kevlar, nylon and combinations of these.

11. The device of claim 1, wherein said lower section has proximate end and an opposite distal end, said proximate end abuts a lower surface of said upper section, and said distal end being in unobstructed communication with free space.

12. The device of claim 1, wherein said upper section is a radially extending lip extending from a core section, and wherein said lower section includes an exterior surface and an opposite interior surface, said exterior surface contacts the transition zone when in said second position and said interior surface being bonded to said core section.

* * * * *